US006155155A

United States Patent [19]

Moshier

[11] Patent Number: 6,155,155

[45] Date of Patent: Dec. 5, 2000

[54] SYSTEM FOR LAUNCHED MUNITION NEUTRALIZATION OF BURIED LAND MINES, SUBSYSTEMS AND COMPONENTS THEREOF

[75] Inventor: Gary S. Moshier, Parsippany, N.J.

[73] Assignee: The United States of America as represented by the Secretary of the Army, Washington, D.C.

[21] Appl. No.: 09/475,738

[22] Filed: Dec. 30, 1999

Related U.S. Application Data

[60] Provisional application No. 60/081,972, Apr. 8, 1998, abandoned, and provisional application No. 60/120,632, Feb. 18, 1999, abandoned.

[51] Int. Cl.[7] ..... F42B 12/20

[52] U.S. Cl. ..... 89/1.13; 89/6.5; 102/403; 102/211

[58] Field of Search ..... 89/1.13, 36.17, 89/6.5; 102/402, 403, 211, 212, 213, 214

[56] References Cited

U.S. PATENT DOCUMENTS

| | | | |
|---|---|---|---|
| 4,050,381 | 9/1977 | Heinemann | 102/211 |
| 4,160,415 | 7/1979 | Cole | 102/214 |
| 4,297,949 | 11/1981 | Glass et al. | 102/403 |
| 5,578,784 | 11/1996 | Karr et al. | 89/36.17 |
| 5,686,686 | 11/1997 | Woodall, Jr. et al. | 89/1.13 |

FOREIGN PATENT DOCUMENTS

| | | | |
|---|---|---|---|
| 232194 | 8/1987 | European Pat. Off. | 89/1.13 |

*Primary Examiner*—Stephen M. Johnson
*Attorney, Agent, or Firm*—John F. Moran; Michael C. Sachs

[57] ABSTRACT

The land mine neutralizing system has a launcher that launches a disk munition, and a means for determining the location of a mine threat. The disk munition is launched in stabilized flight on a predetermined azimuth. A fuze in the disk munition is armed relative to the velocity of the disk munition leaving the launcher, and the disk munition is detonated at a predetermined time that places the disk munition over a mine. A method for neutralizing mines uses the land mine neutralizing system to neutralize a buried mine.

1 Claim, 2 Drawing Sheets

SYSTEM FOR LAUNCHED MUNITION NEUTRALIZATION OF BURIED LAND MINES, SUBSYSTEMS AND COMPONENTS THEREOF

CROSS-REFERENCE TO RELATED APPLICATIONS

This application claims the benefit of priority of the filing date of United States Provisional Application No. 60/081,972, filed Apr. 8, 1998, now abandoned and United States Provisional Application No. 60/120,632, filed Feb. 18, 1999, now abandoned and Application No. PCT/US99/07677, under the Patent Cooperation Treaty, filed Apr. 5, 1999 the entire file wrapper contents of all of which applications are hereby incorporated by reference herein as though fully set forth at length.

GOVERNMENT INTEREST

The invention described herein may be manufactured, licensed, and used by or for the U.S. Government.

BACKGROUND OF THE INVENTION

1. Field of the Invention

The present invention relates to an anti-mine system. In particular, the present invention relates to a launcher system and disk munition for destroying land mines. Most particularly, the launcher of the present invention projects the disk munition over the vicinity of a buried land mine to neutralize the land mine. After the location of a buried land mine is determined, the launcher launches the disk munition along an azimuth in the direction of the mine. A fuze within the disk munition is armed to fire over the mine at a time determined by the exit velocity of the disk munition from the launcher. On detonation, the disk munition has sufficient explosive power to penetrate overburden and destroy or otherwise neutralize the target mine.

2. Brief Description of the Related Art

The removal of buried land mines is a particularly difficult endeavor. Mines are conventionally used to impede the progress of military forces over a given terrain. Selective placement of the mines within an area is used to deny access into the area. Mines also disrupt and demoralize military forces, or terrorize civilian populations. Mines vary in construction and armament, complicating any attempt to neutralize their use, commonly known as mine countermeasures. Significant problems occur when mine countermeasures do not reliably render an area safe for passage, particularly during military operations. Additionally, after a military conflict, residual mines remain hazardous to non-combatants and must be cleared during humanitarian or administrative mine clearing efforts.

Conventional techniques for clearing buried land mines under assault or battlefield conditions include use of vehicle mounted flails, plows and rollers, and detectors, probes and rifles or cannons carried by persons or vehicles. These clearing methods, however, generally present unavoidable risks to personnel in the area. Other techniques employ nets having shaped charges at the intersections of the cords, see U.S. Pat. No. 5,524,524 to Richards et al. and U.S. Pat. No. 5,675,104 to Shorr et al. However, the nets disclosed in these patents may not be useful in particular tactical or logistical situations. Another approach combines a rapid fire cannon with detectors on a vehicle and uses direct cannon fire to destroy the mines. With these direct cannon fire systems target mine neutralization rates decrease significantly with increased engagement ranges.

During tactical operations, individual military units need indigenous capabilities to counter land mine threats to ensure the most rapid deployment of the military unit. Within a military unit, particularly tank platoons, several results are desired for mine clearance systems. First, directed use of mine countermeasure should effectively clear a selected area of land mines with a high level of system accuracy. Second, the mine countermeasure system should readily conform to unit operational logistic capabilities for the movement and handling of mine clearing equipment. Third, the mine clearing system should be capable of expedient deployment, particularly during tactical operations. Fourth, the mine countermeasures system should be simple to deploy and use, when needed. Fifth, mine neutralization should be achievable at extended target engagement distances. Sixth, the mine neutralization system should be capable of rapid engagement of targets, with minimal ricochets or unexploded ordnance after the clearing has occurred.

In view of the foregoing, improvements in mine countermeasures are needed, particularly with regard to mine clearing during military combat operations. In addition to improved reliability of clearing mines, it has been desired to provide relatively long target engagement distances with sufficient target engagement times suitable for military operations. The present invention addresses this and other needs.

SUMMARY OF THE INVENTION

The present invention includes a buried mine neutralizing system comprising a top attack munitions launcher configured to launch a top attack munition against a mine threat and means for determining the location of a mine threat relative to the launcher, wherein the determined location is calculated into a launching azimuth and detonation time of a launched munition.

The present invention also includes a disk munition for neutralizing land mines comprising a disk having a fragmentation component along one side of the disk capable of directional dispersion away from the disk, an explosive component on the opposite side of the disk from the fragmentation component, the explosive component capable of shattering the fragmentation component and imparting a kinetic energy to the shattered fragmentation component effective to neutralize a land mine, and a fuze component capable of detonating the explosive component at a predetermined time, wherein the disk is capable of stabilized flight with the fragmentation component on the bottom side of the disk and the explosive component above the fragmentation component during flight.

Furthermore, the present invention includes a mine neutralizing system comprising a launcher capable of launching a disk munition against a mine threat, means for determining the location of a mine threat, wherein the determined location is calculated into a launching azimuth and detonation time of the launched disk munition, and the disk munition comprising a discus shape having a fragmentation component along one side of the disk munition capable of directional dispersion away from the disk munition, an explosive component on the opposite side of the disk munition from the fragmentation component, the explosive component capable of shattering the fragmentation component and imparting a kinetic energy to the shattered fragmentation component effective to neutralize a land mine, and a fuze component capable of detonating the explosive component at a predetermined time, wherein the disk munition is capable of stabilized flight with the fragmentation component on the bottom side of the disk and the explosive component above the fragmentation component during flight.

Additionally, the present invention includes a method for neutralizing a mine threat, comprising the steps of providing a mine neutralizing system comprising a launcher capable of launching a munition having a disk structure against a mine threat and means for determining the location of a mine threat, wherein the determined location is calculated into a launching azimuth and detonation time of a launched munition, and a disk munition for neutralizing land mines comprising a discus shape having a fragmentation component along one side of the disk munition capable of directional dispersion away from the disk, an explosive component on the opposite side of the disk munition from the fragmentation component, the explosive component capable of shattering the fragmentation component and imparting a kinetic energy to the shattered fragmentation component effective to neutralize a land mine, and a fuze component capable of detonating the explosive component at a predetermined time, wherein the disk munition is capable of stabilized flight with the fragmentation component on the bottom side of the disk munition and the explosive component above the fragmentation component during flight, and launching the disk munition from the mine neutralizing system, wherein the fuze in the disk munition is armed and the disk munition has sufficient rotational spin for stabilized flight over the ground.

Other and further advantages of the present invention are set forth in the description and appended claims.

DETAILED DESCRIPTION OF THE PREFERRED EMBODIMENTS

The mine neutralization system of the present invention effectively destroys or neutralizes buried land mines using a top attack munition. The top attack munition is launched from a launcher along a predetermined azimuth against the mine threat. A fuze within the top attack munition ignites after a predetermined time lapse to coincide with the passing of the top attack munition over the target mine. With the top attack munition located over the mine, the fuze detonates an explosive charge within the top attack munition that propels fragments of the top attack munition into the ground above the buried mine. The propelled fragments contain sufficient explosive and directional force to destroy or neutralized the buried mine, generally through deflagration and/or detonation. The target mines non-exclusively include areas deemed to contain anti-tank mines, anti-personnel mines and/or other similar mines or exploding devices, either within a minefield, or singularly placed within a transit area that pose a threat to advancing soldiers or other personnel, and their equipment.

Figure 1:
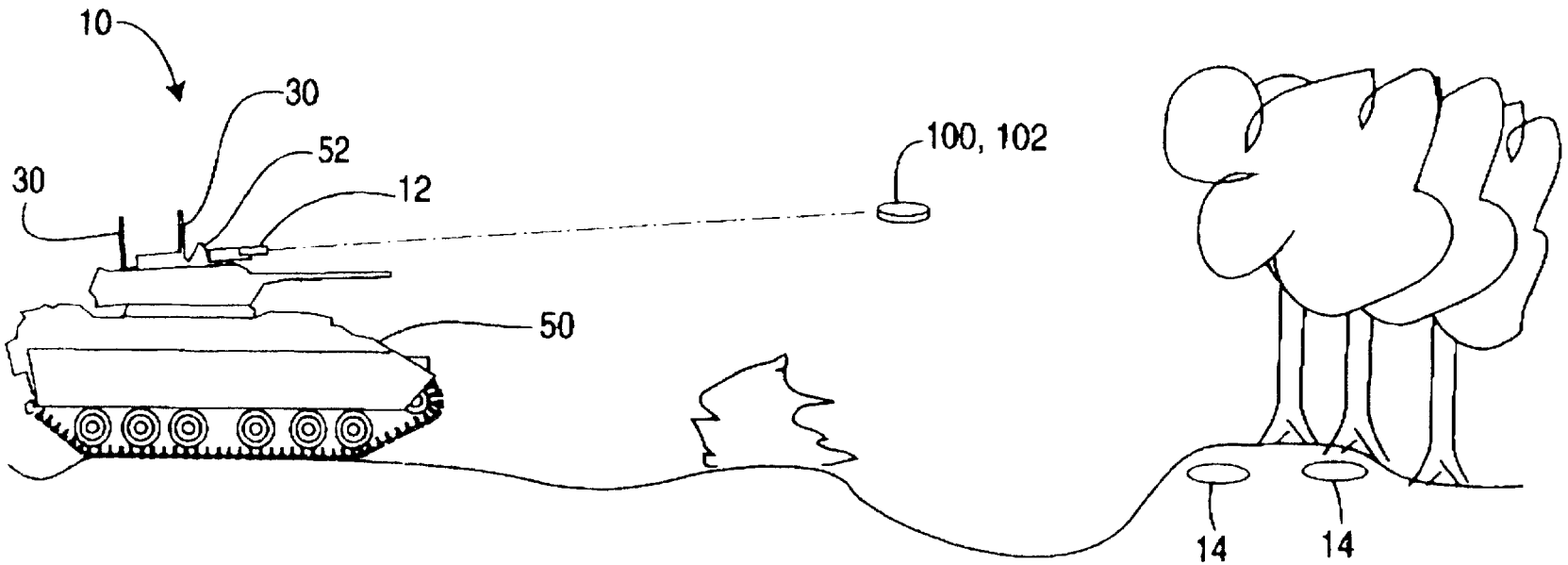
FIG. 1 is an illustration of the deployment of the mine neutralizing system of the present invention engaging a mine threat during military operations.

As seen in FIG. 1, a mine neutralizing system 10 comprises a top attack munition launcher 12, and a means for determining the location of a mine threat 14 in relation to the launcher 12. With the location of the mine 14 fixed, the launcher 12 propels a top attack munitions 100 along an azimuth from the launcher 12 to pass over the buried mine 14. The top attack munition 100 preferably comprises a disk munition 102 shape for stable flight.

The mine neutralizing system 10 may be positioned on any suitable support or platform 50, including for example, fixed legged supports such as staging platforms or columns, or carrier devices such as remote-controlled vehicles, assault vehicles, tanks, and troop carriers. Preferably the platform 50 comprises a remotely controlled non-manned vehicle 50 or combat vehicle, with a tank or assault vehicle platform 50 most preferred. Remote-controlled vehicles may be operated through known methods, such as cable systems extending to another vehicle that is manned, and/or by other communication links between the non-manned vehicle and a controller, with the controller directing the non-manned vehicle from another vehicle, from a command post, or other operational site. Communication links may include microwave, satellite, radio, and/or other known methods. The platform 50 supports the launcher 12 with sufficient stability to allow the launcher 12 to launch a disk munition 102 in a predetermined direction and distance, with selection of the appropriate type of platform 50 for a given situation determinable by those skilled in the art. For battlefield conditions, it is preferred that all components of the mine neutralizing system 10 and the top attack munitions 100 are carried on a single vehicle 50 that is remotely operated to reduce safety hazards with the forward speed of the vehicle 50 while neutralizing a minefield from about 16 km/hr or less.

The launcher 12 is adapted to launch disk munitions 102 in a relatively flat trajectory along a target azimuth line to a predetermined target engagement or standoff distance from a target mine 14. The launcher 12 of the present invention includes any suitable propelling mechanism that imparts a relatively flat stable trajectory on the disk munition 102 along a target azimuth line. The launcher 12 also imparts a given height to the launched disk munition 102 to maximize the distance of the launched disk munition 102, or to by-pass natural or manmade obstacles, such as hills, plants, walls, buildings, and/or other interfering objects located between the launcher 12 and the target mine 14.

Figure 2:
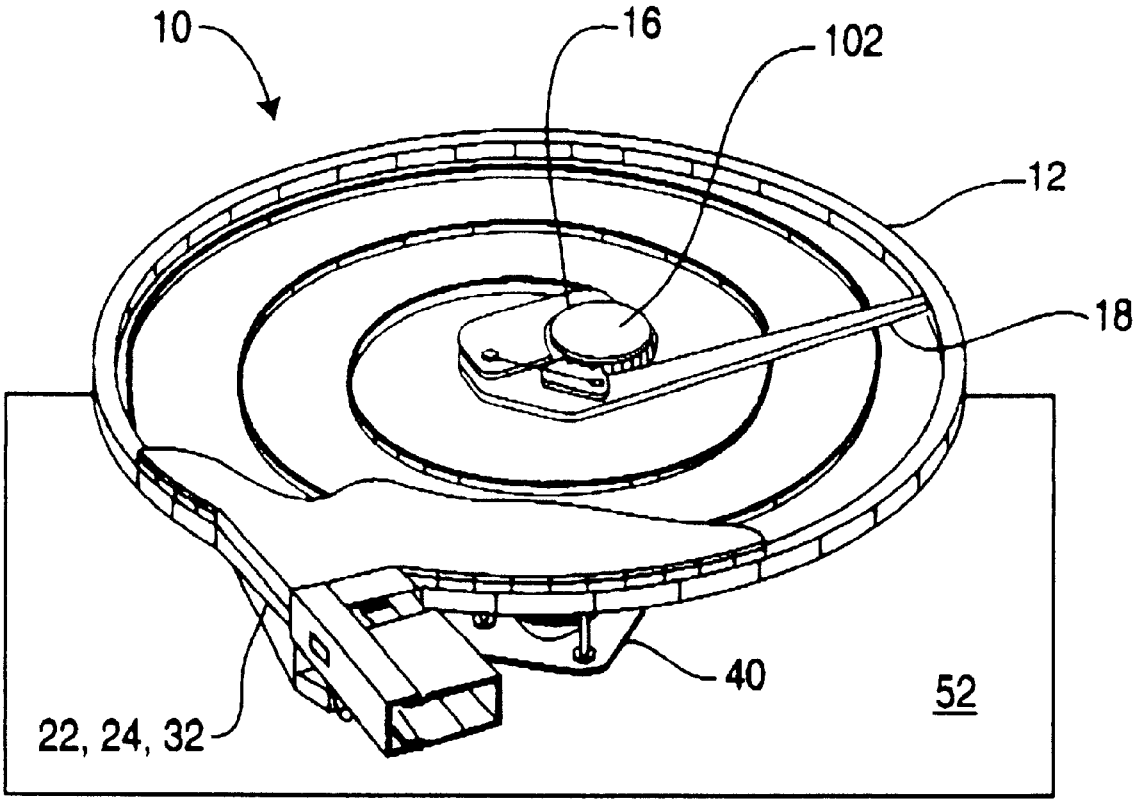
FIG. 2 is perspective view with a cutaway section of the launcher component of the mine neutralizing system of FIG. 1; and, FIG. 3 is a perspective view with a quarter cross-section of the disk munition used in the mine neutralizing system of the present invention shown in FIG. 1.

Suitable propelling mechanisms include lever arms, spring catapults or other devices capable of directing the disk munition 102 along a given azimuth from the launcher 12. As seen in FIG. 2, preferably the propelling mechanism comprises a circular path launching mechanism having a rotational lever arm 18 for handling and projecting the disk munition 102 with sufficient energy over a flight path to reach a target engagement position over the target mines 14. The lever arm 18 comprises any suitable length or width for a given size disk munition 102 for reliably projecting the disk munition 102 at a given speed and azimuth, with preferred lengths of the lever arm 18 ranging from about 2 feet to about 5 feet, and more preferably from about 3 feet to about 4 feet.

The means for determining the location of a mine threat, in addition to locating the mine 14, ranges the located target mine 14 from the launcher 12. The means for determining the location of a mine threat 14 may include sonic, electromagnetic, and/or other sensor devices 30, such as visual detection of the target mines 14, for marking the target mine 14 location, as well as designation of a "hot zone" by tactical commanders to ensure safe passage of troops through a suspect area. Preferred sensors 30 include, without limitation, infrared detection sensors, radar detection sensors, electromagnetic detection sensors and combinations thereof. Sensors 30 preferably include a combination of ground penetrating radar and infrared sensors that are coupled through sensor fusion techniques. Combinations of sensor 30 types are most preferred to provide a high degree of accuracy that reliably locates and identifies both real and false positive mines 14. Other detection and sensing techniques of high accuracy may be used, as suitable. Generally, the type of sensor 30 that may be selected to neutralize the target mine 14 is dictated by the particular circumstances of a military or humanitarian operation, commonly referred to as the "tactical situation", including for instance, the assets available for the military operation, the terrain, the anticipated type of target mine 14, the configuration of the deployed troops, etc., with the sensor 30 selection for a particular military operation determinable by those skilled in the art. Individual target mine selection, i.e., which target mine to launch against, may be directed by a command and control center to most effectively aid in the use of a concentration of military force. Each launcher 12 may be controlled by individuals or squads responsible for an assigned area, or multiple launchers 12 may be located within an area under a common command to most effectively saturate a minefield with mine countermeasures.

Sensors 30 may be locally positioned adjacent to the launcher 12 on the vehicle 50, or positioned away from the vehicle 50 supporting the launcher 12, such as along a ridge line, in an aircraft, or on another vehicle 50. For tactical employment of the present invention, calculation errors generally are reduced with the placement of the sensor 30 adjacent to the launcher 12, with improved reliability occurring by having the sensor 30 positioned on the same vehicle 50 as the launcher 12. Accordingly, when possible and within the capability of the sensor 30, the sensors 30 are preferably carried on the same vehicle or platform 50 as the launcher 12.

The location of the target mine 14 is determined relative to the location of the launcher 12 with the relative location of the mine 14 represented as an azimuth and range calculation from the launcher 12. Azimuth calculations are imparted into the launch sequence of the launcher 12 that directs the launching disk munition 102 along a given bearing, or azimuth, towards the target mine 14 from the launcher 12. Range calculations are compared with an exiting velocity of the disk munition 102 from the launcher 12 to set a time delay within a fuze 110, shown in FIG. 3, incorporated within the disk munition 102. The time delay of the fuze 110 is set to detonate the disk munition 102 as the disk munition 102 arrives over the target mine 14.

As further seen in FIG. 2, individual mine neutralizing systems 10 may launch a single disk munition 102, or multiple sequential rounds at one or more target mines 14. Although other configurations may be used, the launcher 12 preferably positions a single disk munition 102 at a time for launch. Additional disk munitions 102 are contained within a storage compartment or magazine 52 within the vehicle 50, or in a container adjacent to the launcher 12. A re-loader mechanism 40 transits the additional disk munitions 102, individually or collectively, from the storage compartment 52 to a pre-launch position 16 on the launcher 12. When suitable, such as when mounted on larger or unmanned vehicles 50, the launcher 12 comprises an automatic re-loader mechanism 40. Once located at the pre-launch position 16, the disk munition 102 becomes engaged with the lever arm 18 and is launched for flight towards, i.e., along an azimuth to, the target mine 14. Preferably, the disk munitions 102 are arranged within the magazine 52 to provide a pre-arranged sequential order of loading. The pre-arranged disk munitions 102 include, for example, sets of disk munitions 102 pre-loaded into cartridges to facilitate the action of the re-loader mechanism 40 moving the disk munitions 102 from the magazine 50 into the pre-launch position 16. These pre-arranged disk munitions may include standardized disk munition 102 packages that are inserted into the storage compartment 52 for fast and reliable replenishment of the disk munitions 102 within the magazine 52 after the expenditure of a full load of disk munitions 102. Generally, the maximum firing rate of the launcher 12 is limited on the reload capability of the re-loader mechanism 40. Preferably, the launcher 12 configuration permits a firing rate of from about 6 disks/minute or less, more preferably from about 5 disks/minute to about 1 disk/minute, and most preferably from about 4 disks/minute to about 2 disks/minute.

The launcher 12 further comprises a fuze setting means 22 for setting a time delay in the fuze 110 within the disk munition 102 to explode the disk munition 102 at a determinable distance from the launcher 12. As the disk munition 102 transits from the pre-launch position 16, interconnected electronic circuit elements between the launcher 12 and disk munition 102 transfer data to set the fuze 110 of the disk munitions 102 at or before point of departure of the disk munition 102 from the launcher 12. As the disk munition 102 travels through the launcher 12, the fuze 110 becomes set as a calculation of the speed of the disk munition 102 and the distance of the target mine from the launcher 12, with the distance over the ground proportional to the time of flight. A disk munition velocity sensing means 24 within the launcher 12 is used to determine the velocity of each disk munition 102 being fired from the launcher 12. The determined velocity of the disk munition 102 is coupled through the fuze setting means 22 to properly calculate and set the time delay of the fuze 110 to explode the disk munition 102 over the target mine. Improvements in the timing of the disk munition 102 detonation occur with additional factors that correctly measure current conditions of the disk munition 102 launch that are used by the fuze setting means 22 in calculating a set time for the fuze 110, such as the measured disk munition 102 velocity, vehicle 50 travel speed, wind direction and velocity, angle of launch, and other such factors, with the measured velocity of the disk munition 102 being most significant. The integration of these factors in setting the fuze 110 to correctly time the detonation of the disk munition 102 is determinable by those skilled in the art. In its simplest form, an average assumed or expected disk munition 102 velocity is compared to a given target mine 14 range to calculate the time delay of the fuze 110 as the disk munition 102 leaves the launcher 12. This expected velocity remains constant for each disk munition 102 fired from the launcher 12. With the use of a measured disk munition 102 velocity replacing an expected velocity, the accuracy of the detonation of the disk munition 102 significantly increases.

Figure 3:
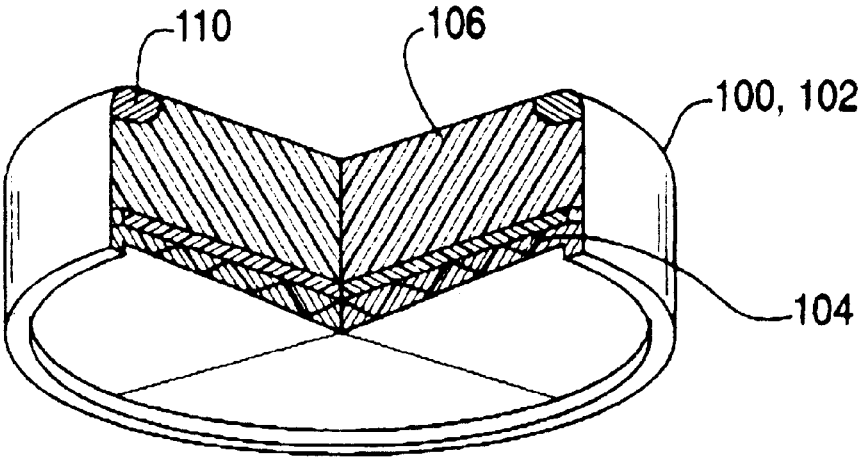

As shown in FIG. 3, the preferred configuration of the top attack munition 100 comprises a discus-shaped configuration, i.e., thicker in the center than at the perimeter, with a fragmentation component 104 along the bottom side of the disk munition 102 and an explosive component 106 along the top side of the disk munition 102. The disk munition 102 has a top cover, a middle cover and a bottom cover for aerodynamic smoothness and stability during its flight to the target. The covers can be of suitable material such as foam plastic, and other like materials. The fragmentation component 104 provides directional dispersion, generally down, with the detonation of the explosive component 106. As the disk munition 102 is projected over the ground in stabilized flight, the fragmentation component 104 travels and continuously remains at the bottom of the disk munition 102 during flight. The explosive component 106 travels and continuously remains on the opposite side from the fragmentation component 104, i.e., the top of the disk munition 102, during flight.

The design and relative location of the explosive component 106 in relation to the fragmentation component 104 imparts directional control of the fragment dispersion on detonation. The configuration of the explosive component 106 maximizes the energy imparted on detonation into the fragmentation component 104, i.e., in a downward direction, while the energy release in all other directions is minimized, with the proper channeling and other configurations of the explosive component 106 determinable by those skilled in the art. The explosive component 106 comprises sufficient explosive material to impart a neutralizing impact of the fragmentation component 104 onto the target mine 14. Preferably, the explosive composition 106 comprises a highly energetic material, such as TNT, etc. With detonation of the explosive component 106 as the disk munition 102 is over the target mine 14, the explosive component 106 shatters the fragmentation component 104 into fragments and imparts a sufficient velocity, or kinetic energy, to the fragments that is effective to neutralize the buried land mine 14, through the penetration, overburdening, burning and/or detonation of the buried mine 14 as the fragments contact the target mine 14.

The fragmentation component 104 of the disk munition 102 comprises a parted or fractured composition of sufficiently heavy material to impart a neutralizing impact onto the target mine 14. Preferably, the fractured composition of the fragmentation component 104 comprises a metal, such as steel, copper, brass or other like dense materials.

In addition to the fragmentation 104 and explosive 106 components of the disk munition 102, the disk munition 102 comprises the fuze 110, as previously described, that is capable of detonating the explosive component 106 at a predetermined time. As the disk munition 102 travels in stabilized flight over the ground with the explosive component 106 above the bottom fragmentation component 104, the proper detonation time, i.e., the detonation of the explosive component 106 when the disk munition 102 is over the target mine, directs the fragments from the fragmentation component 104 into a focused pattern over a specific area containing the target mine 14. The fuze 110 within the disk munition 102 is armed during launch from the launcher 12, with the disk munitions 102 preferably containing fuzes 110 that are settable with target engagement information that is current as of time of departure from the launcher 12. The current information allows the most up-to-date input of the selected factors used in the timing of the fuze 110, which at a minimum includes the distance from the launcher 12 to the target mine with an assumed launch velocity of the disk munition 102.

In one preferred embodiment, the disk munition 102 contains an inductively settable time fuze 110 that can be set by electronic induction as the launcher 12 prepares the disk munition 102 for departure. The mine detection sensor 30 suite provides the range to the target mine 14. This ranging information is supplied to the fuze 110 with devices located within the disk munition 102, such as on board computers, computing the nominal time of flight for the disk munition 102. As the disk munition 102 is prepared to be launched, all factors with the exception of the disk munition 102 velocity are either assumed, measured or disregarded. Velocity detectors 32 located at the exit area of the launcher 12 measure the velocity of the disk munition 102 as the disk munition 102 travels within and through the launcher 12. The disk munition 102 velocity information may be used either directly with the disk munition 102, or within a calculating component of the launcher 12. As a direct velocity input to the disk munition 102, the disk munition 102 receives accurate velocity measurements from the velocity detectors 32 prior to departing the launcher 12 and uses an on board computer to set the timing of the fuze 110. In an alternative method for setting the timing of the fuze 110, velocity measurements are related to the distance variable of the target mine 14 within the launcher 12 which directly sets the timing of the fuze 110 on board the disk munition 102. In either way, precise time of flight, velocity and target engagement range information are inductively set into the fuze 110 at the point of disk munition 102 exit from the launcher 12. This results in disk munition 102 detonation over the target mines 14 with a minimum range error. As described above, this combination of inductive fuzing elements in the disk munition 102 and inductive fuzing circuit elements in the launcher 12 is a valuable subsystem for the application of inductive fuzing to the top attack munitions 100 of the present invention.

Optionally and preferably, the disk munition 102 contains an inductively settable fuze 110 and an on board ballistic computer that cooperates with the mine sensor 30 suite to detonate the disk munition 102 in the vicinity of the target mine 14. In this embodiment, the ballistic computer computes a nominal time of flight or journey to the target mine 14. This nominal time of flight is inductively transferred into the fuze 110 as it is prepared for launch or in the course of being launched. In addition, corrections to this time of flight due to launch velocity variations or new target information are made during the launch. Preferably one or more pairs of velocity sensors 24 in the exit chute of the launcher 12 accurately measure disk munition 102 velocity, allowing the precise time of flight data to be inductively set into the fuze 110 just prior to disk munition 102 departure from the launcher 12. The fuze 110 preferably comprises a minimum fuze time component and a fuze override, that in the event of a mis-launch, disarms the disk munition 102 after launch.

The disk munition 102 comprises a size suitable for launching into stabilized flight over a minefield. In light of normal logistical limitations of a military unit, preferably the diameter of the disk munition 102 is from about 5 inches to about 20 inches, more preferably from about 6 inches to about 15 inches, and most preferably from about 8 inches to about 12 inches. The thickness of disk munition 102 is suitably adjusted to allow stabilized flight of the disk munition 102, with preferred thicknesses ranging from about 1 inch to about 5 inches, more preferably from about 2 inches to about 4 inches, and most preferably from about 2.5 inches to about 3.5 inches.

In a preferred embodiment, the disk munition 102 contains one or more submunitions such as a Multiple Explosively Formed Penetrator (MEFP), developed by the United States Army in furtherance of the present invention. The Multiple Explosively Formed Penetrator is detonated at a position where it is significantly above the overburden of the target buried mines 14 so that it showers the multiple, high energy penetrators down on the target area. In another form, the top attack munition 100 includes one or more shaped charges such as those described in the above cited U.S. Pat. No. 5,614,692 to Brown, et al, and PCT/US98/10586 to Turci, et al., U.S. Pat. No. 5,524,524 to Richards et al. and U.S. Pat. No. 5,675,104 to Shorr et al., the disclosures of which are herein incorporated by reference. Several munitions can be assembled in a common base or individual munitions may be used. As a result of the detonation of the explosive composition 106 and the resulting force on the metal in the submunitions, fragments of metal in the form of penetrators or metallic jets are generated with sufficient energy to penetrate the soil and neutralize the target mine 14. The number of disk munitions 102 required for a particular minefield clearing depends upon the mine footprint, such as from about 0.5 m by 1 m, and the type of submunition. Detonation of the disk munition 102 may significantly overburden the target mine 14, while showering multiple, high energy penetrators down into the target area. The energy within the disk munition 102 is sufficient to neutralize mines 14 with relatively insensitive TNT explosive fills, as well as easier to detonate mines 14.

The present invention includes the combination of the mine neutralizing system 10 and disk munition 102, as previously described. In operation, the combination of the mine neutralizing system 10 and disk munition 102 are positioned within launching distance to the mine 14, such as adjacent to a minefield, and the launcher 12 launches the disk munition 102 with the fuze 110 in the disk munition 102 armed and the disk munition 102 having sufficient rotational spin for stabilized flight over the ground. While launching, the launcher 12 measures the exit velocity of a launched disk munition 102 and sets a timing in the fuze 110 within the launched disk munition 102 proportional to the measured velocity for detonation at a specific distance of flight. The launcher 12 imparts a low rate of disk spin, preferably at a rotational rate of from about 30 revolutions/minute to about 90 revolutions/minute, more preferably from about 40 revolutions/minute to about 80 revolutions/minute, and most preferably from about 50 revolutions/minute to about 70 revolutions/minute. Generally, the disk munition 102 is launched in a ballistic trajectory over the ground at a height of from about 1 meter to about 5 meters, and more preferably from about 2 meters to about 3 meters. The fuze 110 detonates the explosive component 106 within the disk munition 102 at any suitably attainable distance from the vehicle 50, preferably with the distance ranging from about 10 meters to about 100 meters, more preferably from about 15 meters to about 60 meters, and most preferably from about 20 meters to about 30 meters. The minimum target mine 14 engagement range depends upon the type of mine 14 that is being neutralized and the closeness of the target mines 14 to the launcher 12.

The mine neutralizing system 10 clears selected sections of the minefield to form clear pathways for advance of military forces, other mine clearing systems, other vehicles, civilian populations, etc. The present invention is useful in clearing contiguous parts of the same area that need to be cleared. As a minefield presents a barrier to the movement of people or vehicles through an area, the mine neutralizing system 10 may conduct an initial clearing of selected sections of the minefield, or aid in the continued clearing operations conducted in the same minefield. After a clearing by the mine neutralizing system 10, other clearing techniques can then be used to increase the size of the area that is cleared.

The number of disk munitions 102 and the particular target stand-off distance for the disk munition 102 depends upon the type of top attack munition 100 being used and the number of detected buried mines 14 per unit area of the minefield. The total number of hits per unit area for the disk munitions 102 should be enough so that both false positives and real mines 14 each receive an effective "hit", causing all or substantially all real mines 14 to be neutralized. For the Multiple Explosively Formed Penetrator, the standoff range effectively showers the target footprint area with fragments to neutralize any real mines 14. With shaped charge disk munitions 102, an array of the charges in a common base are placed or dispersed within the footprint to overburden the mine 14 with the height of burst above the ground from about two meters or less. At this distance, soil penetration is maximized and neutralization of even very insensitive mines 14, such as those filled with TNT, occurs.

The present invention defeats the target mine 14 at relatively large target engagement distances. By employing the exploding disk munition 102, the present invention penetrates and/or overburdens the mines 14, causing the explosive fill of the mine 14 to explode and/or bum. The launcher 12 and disk munition 102 combination achieves a high level of system accuracy for neutralizing mines 14 by targeting individual mines 14 with individual rounds of the disk munition 102. Additionally, areas of high mine 14 concentrations may be effectively neutralized with saturation of the disk munitions 102 in the area. High efficiency rates over specified time periods are achievable with a rapid disk munition 102 reloading of the launcher 12. Target engagement times are relative to the reloading speed of the launcher 12, target acquisition times, and other factors determinable by those skilled in the art. The present invention reduces or eliminate ricochets, and unexploded ordnance in the area after the mine countermeasures have been employed making the mine neutralizing system 10 useful to both civilian and military personnel. Within a tactical operation, the present invention is useful in aiding military units advance through an area of mines 14. Mines 14 and unexploded ordinance left after a military conflict may be cleared by civilian personnel to render a local area safe for normal commercial transit. When used by either military or civilian authorities, the present invention eliminates many dangers to personnel inherent in mine clearing operations.

It should be understood that the foregoing summary, detailed description, and drawings of the invention are not intended to be limiting, but are only exemplary of the inventive features which are defined in the claims.

What is claimed is:

1. A mine neutralizing system, comprising:

a launcher capable of launching a disk munition against a mine threat;

means for determining the location of a mine threat, wherein the determined location is calculated into a launching azimuth and detonation time of the launched disk munition; and, the disk munition comprising a discus shape having a fragmentation component along one side of the disk munition capable of directional dispersion away from the disk munition, an explosive component on the opposite side of the disk munition from the fragmentation component, the explosive component capable of shattering the fragmentation component and imparting a kinetic energy to the shattered fragmentation component effective to neutralize a land mine, and a fuze component capable of detonating the explosive component at a predetermined time, wherein the disk munition is capable of stabilized flight with the fragmentation component on the bottom side of the disk and the explosive component above the fragmentation component during flight.

* * * * *